United States Patent [19]

Nielsen et al.

[11] Patent Number: 5,025,644

[45] Date of Patent: Jun. 25, 1991

[54] SUEDING MEANS IN A TEXTILE FABRIC-PRODUCING MACHINE

[75] Inventors: Arne Nielsen, Oak Ridge; Majid Moghaddassi, Greensboro, both of N.C.

[73] Assignee: Guilford Mills, Inc., Greensboro, N.C.

[21] Appl. No.: 355,917

[22] Filed: May 23, 1989

[51] Int. Cl.[5] ..... D04B 35/00; D06C 11/00

[52] U.S. Cl. ..... 66/147; 26/28

[58] Field of Search ..... 66/147; 139/291 R; 28/100, 104, 162; 26/28; 29/120, 124–125, 128–129

[56] References Cited

U.S. PATENT DOCUMENTS

| | | | |
|---|---|---|---|
| 2,253,559 | 8/1941 | Curtin | 26/28 |
| 2,352,289 | 6/1944 | Rowe | 29/125 |
| 2,704,392 | 3/1955 | Schultz | 29/120 |
| 3,001,682 | 9/1961 | Carroll et al. | 29/125 |
| 3,068,544 | 12/1962 | Connell et al. | 26/28 |
| 3,217,554 | 11/1965 | Stalker | 29/129 |
| 3,553,801 | 2/1968 | Hadley | 26/28 |
| 3,967,470 | 7/1976 | Miura et al. | 66/147 |
| 4,512,065 | 4/1985 | Otto | 28/103 |
| 4,820,249 | 4/1989 | Wech | 29/125 |

FOREIGN PATENT DOCUMENTS

| | | | |
|---|---|---|---|
| 2900246 | 7/1979 | Fed. Rep. of Germany | 26/28 |
| 0227992 | 10/1985 | Fed. Rep. of Germany | 66/147 |

OTHER PUBLICATIONS

Advertising brochure, Karl Mayer Textilmaschinenfabrik GmbH, West Germany, entitled, "Frottier-Kettenwirkautomaten Warp Knitting Machines for Terry Towelling," dated 8/4/81/9/83.

Article entitled "Improved KS4FBZ Terry Tricot Machine for Made-Up Terry Hand Towels," Kettenwirk--Praxis, West Germany, dated 3/76.

"Article, entitled KS4F; KS4FB and KS4FBZ Terry Tricot Machines," Kettenwirk-Praxis, West Germany, dated 3/84.

Advertising brochure, Sperotto SpA, Italy, entitled "SM.7 New Sueding Machines for Wovens and Knitteds," date unknown.

Advertising Brochure Curtin-Hebert Co. Inc., Gloversville, N.Y., entitled "Curtin-Hebert Co. Inc. 710 Series," date unknown.

Advertising brochure, Davis Gessner Company, Worcester, Mass., entitled "Sensi-Touch Cloth Sanding Machine," dated 1/76.

*Primary Examiner*—Werner H. Schroeder
*Assistant Examiner*—John J. Calvert
*Attorney, Agent, or Firm*—Shefte, Pinckney & Sawyer

[57] ABSTRACT

A textile warp knitting machine is equipped with a driven sandpaper-covered sueding roll extending the full width of the fabric take-up section of the machine for peripheral engagement of the warp knitted fabric with the sueding roll to produce a raised suede-like nap on one fabric surface. The sueding roll is driven oppositely to the direction of fabric travel. The fabric is guided to contact the sueding roll periphery at two opposite locations thereon.

23 Claims, 4 Drawing Sheets

SUEDING MEANS IN A TEXTILE FABRIC-PRODUCING MACHINE

BACKGROUND OF THE INVENTION

The present invention relates generally to textile processing apparatus adapted for developing a suede-like finish on a textile fabric and relates more particularly to a sueding arrangement for incorporation in a fabric-forming machine, such as a textile warp knitting machine.

In the textile industry, it is known to finish certain woven and warp knitted fabrics by abrading one or both surfaces of the fabric using a sandpaper or similarly abrasive material to cut and raise constituent surface yarns in the fabric into a closely raised nap producing a soft, smooth surface texture resembling suede leather. This operation, commonly referred to as sueding or sanding, is conventionally performed by a specialized fabric sueding machine wherein the fabric is passed under considerable tension over one or more finishing rolls covered with sandpaper or a similarly abrasive material which are rotated rapidly in the same direction as the fabric travels.

While conventional sueding operations produce satisfactory results in fabrics finished in this manner, several significant disadvantages of conventional sueding equipment detract from its desirability and economy. The relatively high rotational speeds at which the abrasive rolls of conventional sueding machines operate necessarily causes a substantial amount of fibrous lint and fly, fabric finish, abrasive dust and the like to be released from the fabric and the abrasive rolls, some of which may tend to become airborne posing a health hazard to machine operators, some of which may tend to become embedded in the interstices of the fabric detracting from its surface finish, and some of which may tend to accumulate on the abrasive surface of the finishing rolls tending to negate at least somewhat their abrasive sueding effect. To attempt to minimize these problems, conventional sueding machines are typically provided with relatively substantial suction-operated filtering arrangements for withdrawing liberated debris from the regions of the sueding rolls. Even so, the accumulation of debris on the sueding rolls generally occurs rapidly enough that it is commonly necessary to change the sandpaper or abrasive surface material on the rolls for every individual roll of fabric processed.

Additionally, conventional sueding machines are typically limited in their operational widths to the processing of fabrics no greater on average than 60 to 65 inches in width. In most conventional sueding machines, a nip roller or nose bar or another similar mechanical component is employed to hold the fabric against the rotating periphery of the sueding rolls along the full length of each roll and, accordingly, it is highly important that the sueding roll as well as the nip roll or nose bar be very true cylindrically to achieve uniform engagement and sueding effect along the full length of the sueding roll. As will thus be understood, it is highly impractical from an engineering design standpoint to utilize a sueding roll much greater in length than now conventional because the centrifugal forces present at the high rotational speeds at which such rolls operate together with the increased weight of a longer roll would naturally tend to cause deflection of the roll from a true cylindrical configuration as well as being more difficult to balance properly to minimize rotational vibration of the roll. On the other hand, many conventional weaving and warp knitting machines are available for producing fabrics in widths two to three times or more greater in width than the effective operating width of conventional sueding equipment. For example, warp knitting machinery currently in use is capable of producing warp knitted fabrics of 126 inches to 168 inches in width. Conventional weaving machines capable of producing fabrics of comparable widths are also available. Thus, when it is desired to produce a suede finish on fabrics of such greater widths than the maximum widthwise finishing capability of sueding machines, it is necessary to initially cut the fabric lengthwise into at least two smaller width lengths which are then individually processed through a sueding machine.

SUMMARY OF THE INVENTION

It is accordingly an object of the present invention to provide a sueding arrangement for incorporation in a textile weaving, knitting or other fabric-producing machine which forms fabrics in flat open-width form so that the fabric produced by such machines may be sueded as an integral part of the fabric forming operation, thus eliminating the need for a separate sueding operation, avoiding the disadvantages thereof, and realizing significant cost savings thereover.

Briefly summarized, the sueding arrangement of the present invention is operative for sueding the fabric in its full open-width form while on the textile fabric-producing machine intermediate the location on the machine of its mechanism for manipulating yarn to form the fabric and the following fabric takeup location of the machine. Basically, the sueding arrangement includes a sueding roll having an abrasive peripheral surface, a guide arrangement for directing the fabric to travel intermediate the yarn manipulating mechanism and the fabric take-up location in peripheral surface engagement with the sueding roll, and a drive for rotating the sueding roll at a peripheral surface speed compatibly related to the traveling speed of the fabric.

In a preferred embodiment of the present sueding arrangement in a textile warp knitting machine, the sueding arrangement is located between the needle bar mechanism of the machine and the driven take-up roll of the machine. The guide arrangement of the sueding arrangement includes a plurality of guide rolls which direct the fabric to travel in peripheral surface engagement with the sueding roll at two distinct locations thereon, preferably at essentially opposite sides of the sueding roll, and the drive is operative to rotate the sueding roll in a direction at its peripheral surface opposite the direction of travel of the fabric. The fabric guide arrangement is further operative for tensioning the fabric at the locations of its peripheral surface engagement with the sueding roll to maintain engagement therebetween and for developing a relatively lesser force of engagement of the fabric with the sueding roll at the location of first engagement with the sueding roll sufficient generally only to raise the engaged surface of the fabric and a relatively greater force of engagement of the fabric with the sueding roll at the location of second engagement with the sueding roll sufficient to cut constituent yarns of the fabric.

Preferably, the drive of the present sueding arrangement includes the capability for selectively changing the rotational speed of the sueding roll for adjustment thereof over the life of the abrasive peripheral surface to accommodate for wearing thereof. Further, the drive is synchronized with the knitting or other fabric-producing machine for operation in unison to prevent formation of stop marks and other defects in the fabric. A movable dancer roll arrangement is provided for monitoring tension and speed fluctuations in the fabric and to adjust the driven speed of the take-up roll in relation thereto. It is also preferred that the drive include a selectively operable clutch to allow idling rotation of the sueding roll for non-sueding operation of the knitting or other fabric-producing machine. The sueding roll itself preferably includes a cylindrical outer shell with an elongate shaft extending axially centrally through the interior of the shell and a plurality of support plates extending radially between the shaft and the shell at spacings along the shaft.

DESCRIPTION OF THE PREFERRED EMBODIMENT

Figure 1:
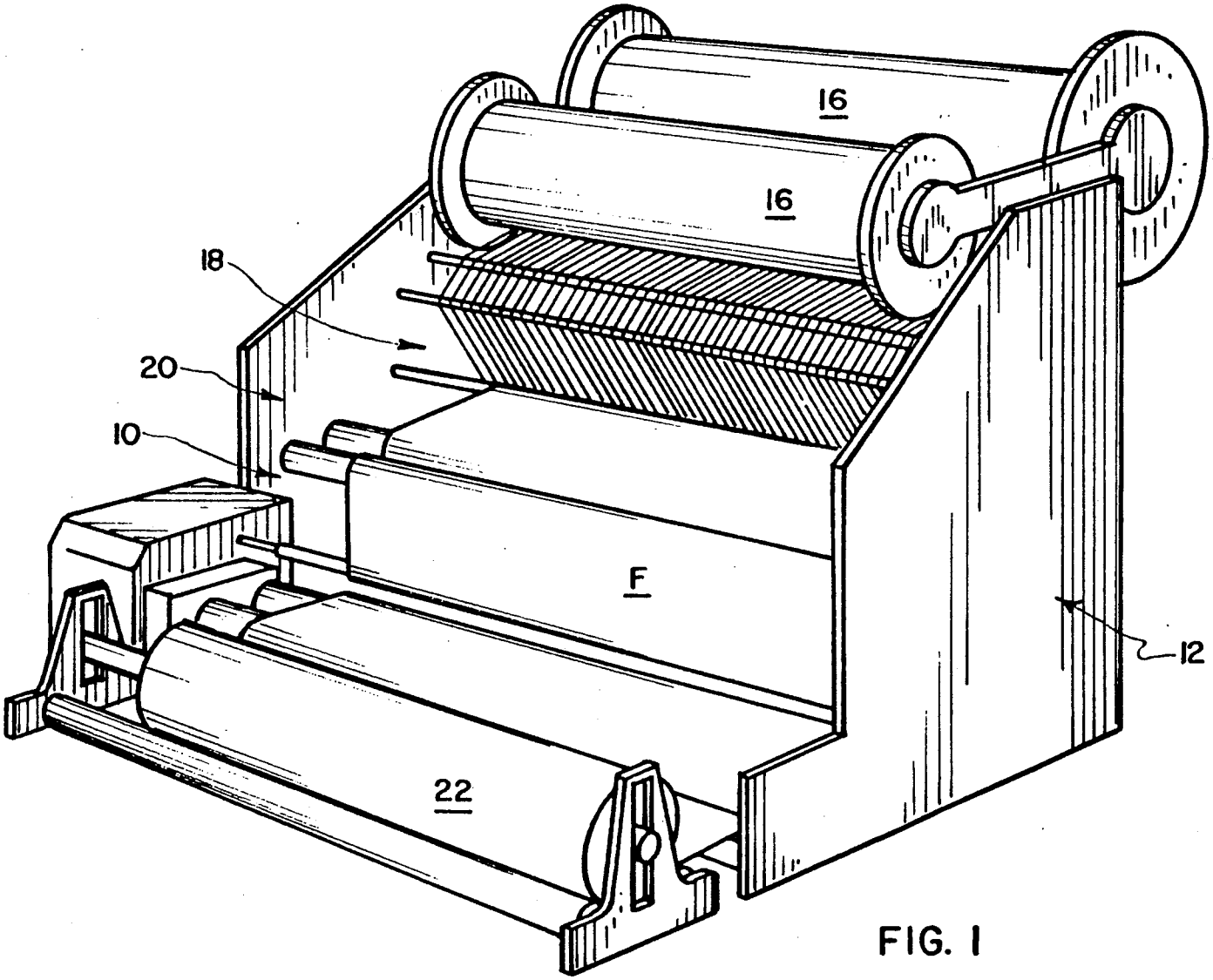
FIG. 1 is a perspective view of a textile warp knitting machine in which the sueding arrangement of the present invention is preferably embodied.

Referring now to the accompanying drawings and initially to FIG. 1, a sueding arrangement according to the present invention is indicated generally at 10 as preferably embodied in an otherwise conventional textile warp knitting machine, indicated at 12. The basic construction and operation of the warp knitting machine 12 is well known and therefore is not described in detail herein, except insofar as necessary to facilitate an understanding of the present sueding arrangement 10.

Basically, the warp knitting machine 12 has an extended elongate frame which supports at an overhead elevation a series of warp beams 16 having a plurality of warp yarns wound in side-by-side relation thereabout for feeding of the yarns in a sheet-like form downwardly to a knitting arrangement of a series of interactive yarn guide and needle bars, indicated generally at 18, for knitting manipulation of the yarns to form a fabric in flat open-width form, indicated at F, from which the fabric is directed through a fabric take-up section, indicated generally at 20, having a series of fabric guide rolls for directing the fabric for ultimate winding onto a storage roll 22. The maximum possible width to which the fabric F may be knitted by the warp knitting machine 12 is determined by the operative respective lengths of the yarn guide and needle bars of the knitting arrangement 18, as those persons skilled in the art will understand. As illustrated, the knitting machine 12 is representative of conventional warp knitting machines capable of knitting fabrics in widths up to 126 inches. However, it is to be understood that the sueding arrangement 10 of the present invention is equally adaptable for incorporation in textile warp knitting machines of any other size and fabric width capability, including for example warp knitting machines adapted for knitting fabrics up to widths of 168 inches, as well as many textile weaving machines and other textile fabric forming machines for producing fabrics to which it may be desirable to provide a suede finish.

Figure 2:
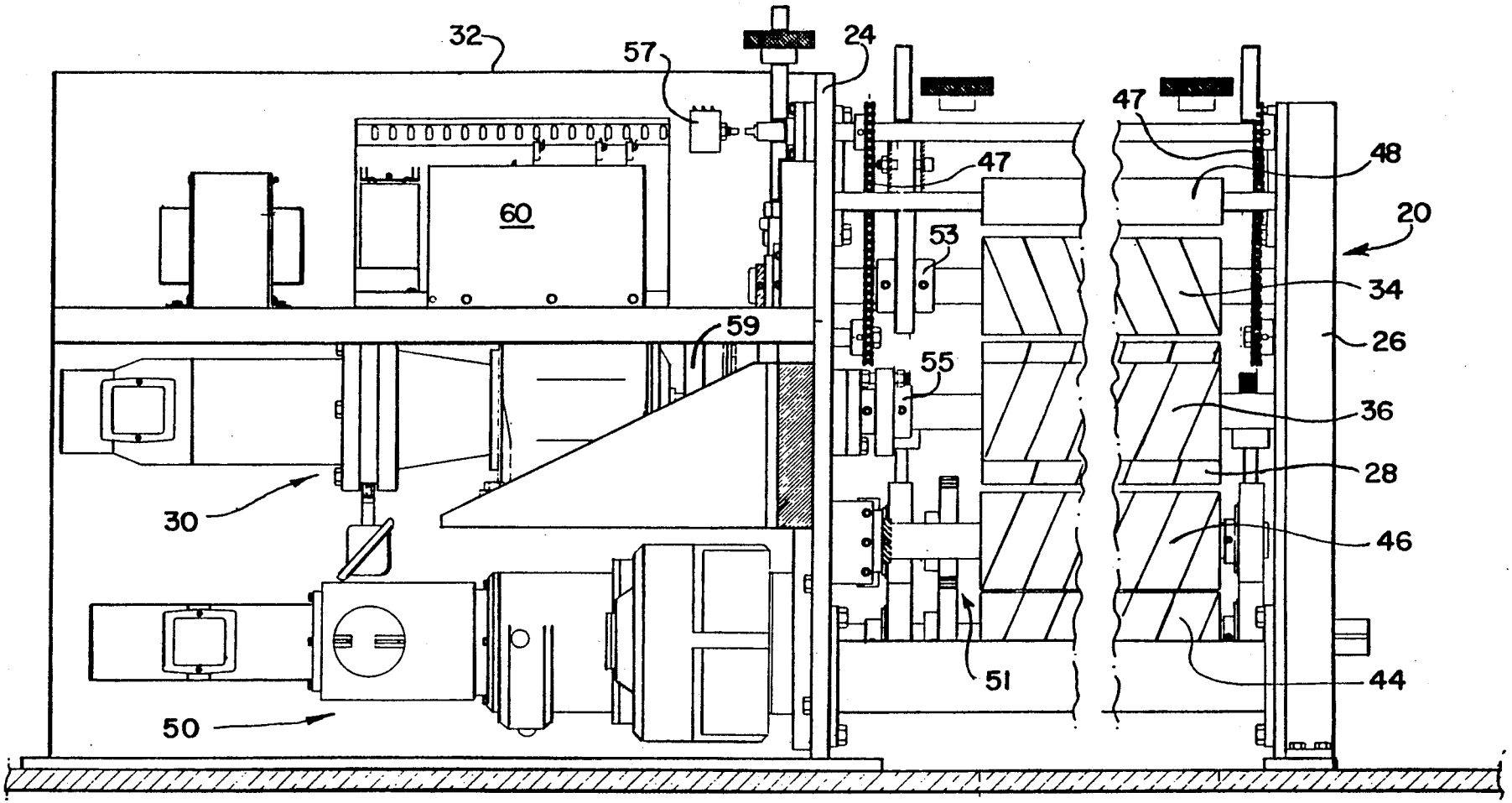
FIG. 2 is a front elevational view of the fabric take-up section of the warp knitting machine of FIG. 1, showing the sueding arrangement of the present invention as embodied therein.
Figure 3:
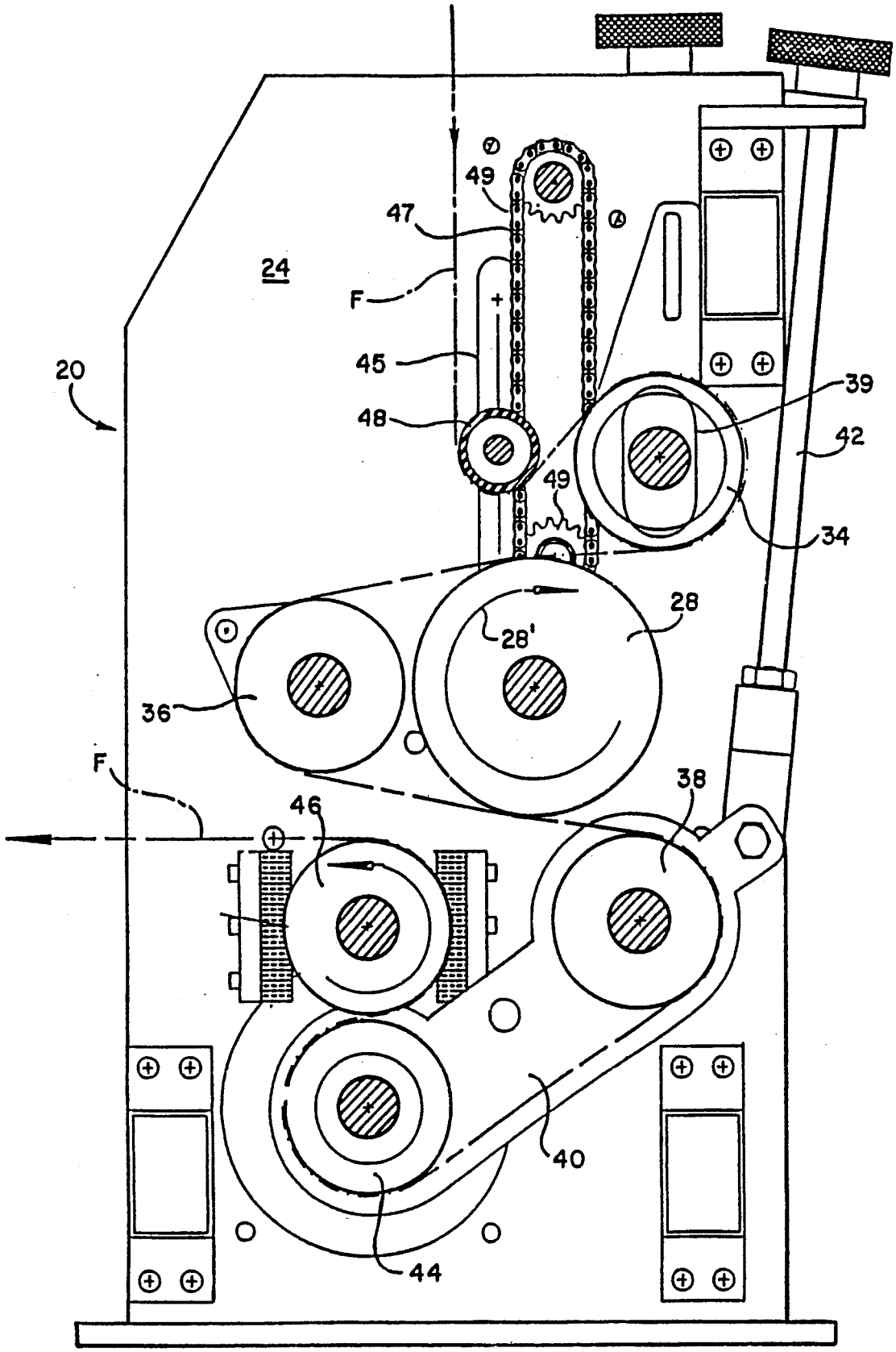
FIG. 3 is an end elevational view of the fabric take-up section and sueding arrangement of FIG. 2.

As best seen in FIGS. 2 and 3, the sueding arrangement 10 of the present invention is incorporated in the take-up section 20 of the warp knitting machine 12 for performing a sueding operation on the fabric F in its full open-width form at a location intermediate the knitting arrangement 18 and the winding of the fabric F on the storage roll 22, as more fully explained hereinafter. The take-up section 20 of the knitting machine 12 includes a pair of upright end frame members 24, 26 arranged in spaced facing relation at opposite ends of the knitting machine 12. The sueding arrangement 10 includes a sueding roll 28 rotatably supported at its opposite ends by respective bearings mounted to the end frame members 24, 26 to extend laterally therebetween. A series of three guide rolls 34, 36, 38 are similarly mounted rotatably at their opposite ends to the end frame members 24, 26 to extend laterally therebetween in axially parallel relation to the sueding roll 28 in a generally triangular relation to one another at circumferential spacings about the sueding roll 28. The opposite ends of the guide roll 34 are disposed within vertically extending slots 39 formed in facing relation in the respective end frame members 24, 26 for adjusting disposition of the guide roll 34 vertically toward and away from the sueding roll 28. The opposite ends of the guide roll 38 are supported by a pair of arm members 40 respectively pivoted coaxially to the end frame members 24, 26 to be adjustably movable toward and away from the sueding roll 28 by adjusting screws 42 each extending between a respective end frame member 24, 26 and the free end of a respective pivot support arm 40. A pair of take-up rolls 44, 46 are likewise rotatably supported at their respective ends in bearings mounted to the end frame members 24, 26 to extend therebetween in closely spaced axially parallel relation to one another and to the sueding and guide rolls 28, 34, 36, 38, the take-up roll 44 being supported coaxially with the pivot axis of the pivot arms 40. A dancer roll 48 is also rotatably mounted at its opposite ends to the end frame members 24, 26 in corresponding vertical slots 45 formed therein for movement in a vertical plane to compensate for fabric tension and speed fluctuations during operation of the knitting machine 12 and the sueding arrangement 10, as hereinafter described. The dancer roll 48 is connected at the opposite ends of its shaft to a pair of timing chains 47 each trained about a set of sprockets 49 to insure that the dancer roll 48 moves within the slots 45 in axially parallel relation to the sueding, guide and take-up rolls.

As shown in FIG. 3, the fabric F is trained to travel downwardly from the knitting arrangement 18 and through the takeup section 20 initially beneath the periphery of the dancer roll 48, therefrom about the periphery of the guide roll 34, then in generally tangential peripheral surface contact with the upwardly facing side of the sueding roll 28, therefrom peripherally about the guide roll 36, then once again in generally tangential peripheral surface contact with the sueding roll 28 at its downwardly facing side, therefrom peripherally about the guide roll 38, beneath the periphery of the take-up roll 44 and over the periphery of the take-up roll 46, from which the fabric F is directed by additional guide rolls (not shown) for winding about the storage roll 22.

The take-up roll 44 is driven in a clockwise direction, as viewed in FIG. 3, and through intermediate gears, indicated generally at 51 in FIG. 2, drives the guide roll 38 in the same direction, to transport the fabric F through the take-up section 20 under tension. As indicated by the directional arrow 28', the sueding roll 28 is driven to rotate clockwise, as viewed in FIG. 3, so that its peripheral surface moves opposite to the direction of travel of the fabric F at each location of contact between the fabric F and the sueding roll 28. As best seen in FIG. 2, the sueding roll 28 and the take-up roll 44 are separately driven by individual respective drive motor and drive gear assemblies 30, 50, mounted within a control housing 32 affixed outwardly to the end frame member 24. Preferably, the drive gearing for the sueding roll 28 includes a selectively operable clutch 59 by which the sueding roll 28 may be selectively freed from its drive gear train for free idling rotation when operation of the sueding arrangement 10 is not desired. The dancer roll 48 and each guide roll 34, 36 are freely rotatable in the direction of traveling movement of the fabric F to act as idler rolls, the respective support bearings 53, 55 (FIG. 2) for the guide rolls 34, 36 having a clutch mechanism to prevent reverse rotation to resist any tendency of the driving force of the sueding roll 28 acting through the fabric F to drive the rolls 34, 36 in the opposite direction, thereby to maintain uniform tension in the fabric F at its points of contact with the sueding roll 28.

An electronic motor controller unit 60 is also provided within the control housing 32 and is electrically connected with the drive motors 30, 50 for actuating and controlling their respective operations, along with other operating components of the knitting machine 12. Each drive motor 30, 50 is preferably a variable speed electric motor, the motor controller unit 60 enabling the particular respective speeds of the motors 30, 50 to be selectively set. In addition, the motor controller unit 60 is operative in response to a tachogenerator or other suitable sensing device monitoring the speed of the main shaft of the knitting machine to maintain the drive motors 30, 50 in continuous full synchronism throughout the entire operation of the warp knitting machine 12, including particularly during start-up and stoppages of the warp knitting machine 12, such as occurs for example upon actuation of a conventional stop motion device, so that the operation of the sueding roll 28 and the fabric F accelerate and decelerate in synchronism with one another during machine starts and stoppages and otherwise to achieve a uniform sueding effect on the fabric F and thereby avoid the formation of so-called stop marks widthwise across the portion of the fabric F which travels over the sueding roll 28 during starts and stoppages of the machine and to avoid other similar fabric defects resulting from nonuniform fabric speed and tension.

Similarly, a potentiometer 57 is provided in operative association with the shaft of the dancer roll 48 to recognize movement thereof vertically within the slots 45 indicative of speed or tension fluctuations in the fabric F, the potentiometer 57 being connected with the motor controller 60 to actuate corresponding adjustments in the driven speed of the take-up roll 44 to compensate for such fluctuations.

Figure 4:
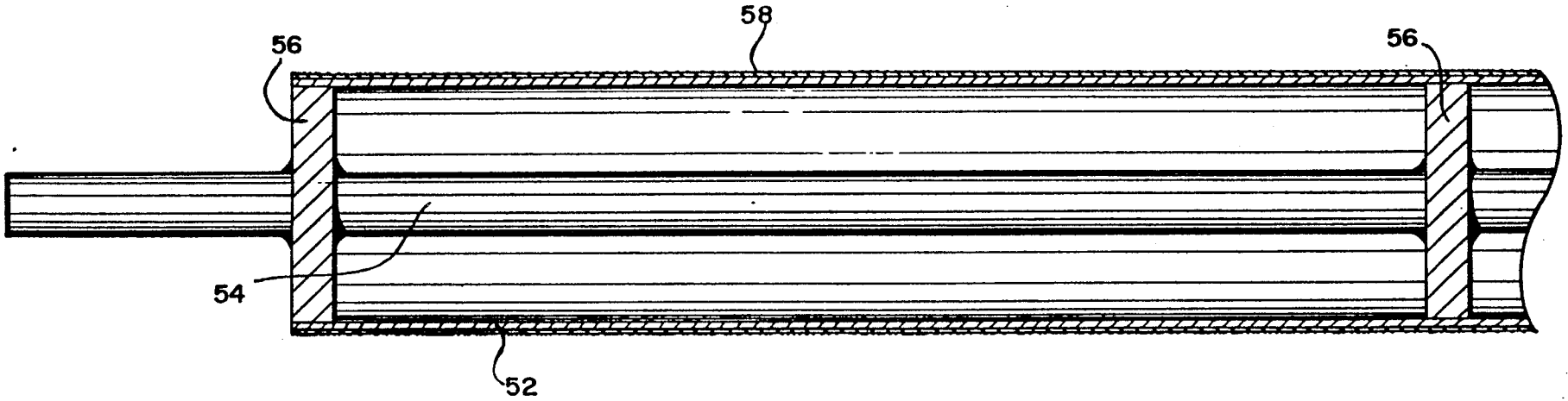
FIG. 4 is a lengthwise cross-sectional view of the sueding roll of the sueding arrangement of the present invention.

The construction of the sueding roll 28 is best shown in FIG. 4. To minimize the overall weight of the sueding roll 28, the roll 28 is basically of a hollow construction formed by a hollow, seamless, cylindrical outer shell 52 mounted on a central coaxially extending shaft 54 by a series of circular support walls 56 affixed radially between the shaft 54 and the interior periphery of the cylindrical shell 52 at uniform axial spacings therealong. As will be understood, the support walls 56 serve to maintain the cylindricality of the shell 52 against deformation without contributing significantly to the overall weight of the sueding roll 28. The axial shaft 54 projects beyond each opposite end of the shell 52 for mounting as aforementioned to the opposite end frame members 24, 26, and to its associated drive motor 30. The outer periphery of the sueding roll 28 is fitted with a removable spirally-wound sleeve 58 of sandpaper or another abrasive material suitable for fabric sueding operations, or as those persons skilled in the art will understand the outer periphery of the sueding roll 28 may be otherwise formed or provided with a similarly abrasive surface character in any other appropriate manner rendering the sueding roll 28 capable for performing a sueding or sanding operation on a textile fabric.

The operation of the sueding arrangement 10 in the warp knitting machine 12 may thus be understood. In the initial set-up of the warp knitting machine 12 for a combined fabric knitting and sueding operation, the disposition of the guide roll 34 within the slots 39 in the respective end frame members 24, 26 and the pivoted disposition of the guide roll 38 as determined by the adjusting screws 42 are adjustably preset in relation to the sueding roll 28 to hold the fabric F in tensioned surface engagement with the periphery of the sueding roll 28 at its upwardly facing side whereat the fabric F first contacts the sueding roll 28 sufficient that the abrasive periphery of the sueding roll 28 essentially only will raise the constituent surface yarns of the fabric F without cutting them and to hold the fabric F in tensioned surface engagement with the periphery of the sueding roll 28 at its downwardly facing side whereat the fabric F subsequently recontacts the sueding roll 28 with a relatively greater force of engagement sufficient that the abrasive periphery of the sueding roll 28 will cut the raised constituent surface yarns of the fabric F. The motor controller unit 60 is preset to establish an appropriate desirable speed of operation of the knitting machine operating components, including the driven speed of the take-up roll 44, which determines the traveling speed of the fabric F through the take-up section 20, and also to establish a compatible peripheral surface speed of the sueding roll 28. As will be understood by those persons skilled in the art, the fabric take-up speed of conventional warp knitting machines may range from 10 to 50 inches per minute, sometimes more or less, depending upon the fabric being knitted. The surface speed of the sueding roll 28 when fitted with a sleeve 58 of conventional sandpaper as the abrasive media will normally range between approximately 130 and 300 inches per minute, although the sueding roll surface speed may be more or less depending upon the particular fabric, other machine operating parameters, the desired sueding effect, etc. In any event, these operational parameters of the present sueding arrangement 10 are in substantial contrast to conventional sueding and sanding machines which operate at a fabric traveling speed generally in the range of 10 to 30 yards per minute with their sueding cylinders being rotated as a peripheral surface speed in the range of 7500 inches per minute or more in a direction of peripheral movement the same as the direction of fabric travel. Thus, as the knitting machine 12 is operated to knit the fabric F at the knitting arrangement 18 and subsequently take-up the fabric F through the take-up section 20, the sueding roll 28 performs a sueding operation on the fabric F as it passes twice over the oppositely rotating abrasive periphery of the sueding roll 28.

Several distinct advantages are realized from the present invention. As will readily be appreciated, the performance of a sueding operation on the fabric F as part of the initial fabric-forming operation substantially eliminates the need for performing a subsequent separate sueding process on the fabric F using an independent sueding machine and the necessity beforehand of cutting the fabric lengthwise into fabric widths compatible with a conventional sueding machine. As such, substantial cost savings may be realized, both in reduced capital equipment costs associated with acquiring separate sueding machines and in direct fabric production costs. Additionally, the relatively slow rotational operating speeds at which the sueding roll 28 is operated according to the present invention produces minimal fibrous fly, dust and the like so that a vacuum-operated filtration system is unnecessary in the present sueding arrangement 10 for collecting such waste and, at the same time, the accumulation of such waste on the abrasive periphery of the sueding roll 28 develops much more slowly so that the sandpaper sleeve or other abrasive material generally has a much more extended life than is typical with conventional sueding machines. For example, it has been found in preliminary testing that a sandpaper sleeve operated on the sueding roll 28 in a conventional warp knitting machine 12 can be expected to operate serviceably through four to five complete doffs of fabric rolls 22 from the knitting machine 12.

Of course, it will be understood that the sandpaper sleeve 58 or other abrasive material on the sueding roll 28 will gradually wear over the course of its life. It has been found that selectively increasing the peripheral surface speed of the sueding roll 28 an incremental amount following the completion of each doffing operation is effective to compensate for such wearing so that substantially uniform sueding results are achieved over the entire life of the periphery of the sueding roll. As an alternative, it may be desirable to incrementally increase the peripheral surface speed of the sueding roll 28 more frequently or even to gradually increase its speed continuously over the life of its abrasive periphery. On the other hand, it is believed unnecessary to vary the tensioning of the fabric over the life of the sueding roll 28.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile fabric-producing machine of the type having means for manipulating yarn to form a fabric in flat open-width form and a location following the yarn manipulating means for take-up of the fabric, the improvement comprising means for sueding the fabric in full width form intermediate the yarn manipulating means and the take-up location, the sueding means comprising a sueding roll having an abrasive peripheral surface, means for directing the fabric to t ravel intermediate the yarn manipulating means and the take-up location in peripheral surface engagement with the sueding roll, the fabric directing means including dancer rolls means for monitoring tension and speed fluctuations in the fabric and adjusting the fabric directing means in relation thereto, and means for driving rotation of the sueding roll at a peripheral surface speed compatibly related to the traveling speed of the fabric.

2. Sueding means in a textile fabric-producing machine according to claim 1 and characterized further in that the abrasive peripheral surface of the sueding roll comprises sandpaper.

3. Sueding means in a textile fabric-producing machine according to claim 1 and characterized further in that the driving means is operative for rotating the sueding roll in a direction at its peripheral surface opposite the direction of travel of the fabric.

4. Sueding means in a textile fabric-producing machine according to claim 1 and characterized further in that the fabric directing means is operative for tensioning the fabric at the location of its peripheral surface engagement with the sueding roll to maintain engagement therebetween.

5. Sueding means in a textile fabric-producing machine according to claim 1 and characterized further in that the fabric directing means is arranged for engaging the fabric with the peripheral surface of the sueding roll at two distinct locations thereon.

6. Sueding means in a textile fabric-producing machine according to claim 5 and characterized further in that the fabric directing means is arranged for engaging the fabric with the peripheral surface of the sueding roll at generally opposite sides thereof.

7. Sueding means in a textile fabric-producing machine according to claim 5 and characterized further in that the fabric directing means is operative for tensioning the fabric at the locations of its peripheral surface engagement with the sueding roll to maintain engagement therebetween and for developing a relatively lesser force of engagement of the fabric with the sueding roll at the location of first engagement with the sueding roll sufficient generally only to raise the engaged surface of the fabric and a relatively greater force of engagement of the fabric with the sueding roll at the location of second engagement with the sueding roll sufficient to cut constituent yarns of the fabric.

8. Sueding means in a textile fabric-producing machine according to claim 1 and characterized further in that the driving means includes means for selectively changing the rotational speed of the sueding roll for adjustment thereof over the life of the abrasive peripheral surface to accommodate for wearing thereof.

9. Sueding means in a textile fabric-producing machine according to claim 1 and characterized further in that the driving means is synchronized with the fabric-producing machine for operation in unison to prevent formation of stop marks in the fabric.

10. Sueding means in a textile fabric-producing machine according to claim 1 and characterized further in that the sueding roll comprises a tubular outer shell and support means within the interior of the shell to prevent distortion of the tubular configuration of the shell.

11. Sueding means in a textile fabric-producing machine according to claim 10 and characterized further in that the support means comprises an elongate shaft extending axially centrally through the interior of the shell and a plurality of support plates extending radially between the shaft and the shell at spacings along the shaft.

12. Sueding means in a textile fabric-producing machine according to claim 1 and characterized further in that the driving means includes clutch means selectively operable for idling rotation of the sueding roll for non-sueding operation of the fabric-producing machine.

13. In a textile warp knitting machine of the type having at least one needle bar for manipulating yarn to knit a fabric in flat open-width form and a driven take-up roll for winding of the fabric, the improvement comprising means for sueding the fabric in full width form intermediate the needle bar and the take-up roll, the sueding means comprising a sueding roll having an abrasive peripheral surface formed of sandpaper, a plurality of guide rolls for directing the fabric to travel intermediate the needle bar and the take-up roll in peripheral surface engagement with the sueding roll at two distinct locations thereon, dancer roll means for monitoring tension and speed fluctuations in the fabric and associated with the take-up roll for adjusting the driven speed thereof in relation to the fluctuations, and means for driving rotation of the sueding roll at a peripheral surface speed compatibly related to the peripheral surface of the sueding roll opposite the direction of the travel of the fabric.

14. Sueding means in a textile warp knitting machine according to claim 13 and characterized further in that the fabric directing means is arranged for engaging the fabric with the peripheral surface of the sueding roll at generally opposite sides thereof.

15. Sueding means in a textile warp knitting machine according to claim 13 and characterized further in that the fabric directing means is operative for tensioning the fabric at the locations of its peripheral surface engagement with the sueding roll to maintain engagement therebetween and for developing a relatively lesser force of engagement of the fabric with the sueding roll at the location of first engagement with the sueding roll sufficient generally only to raise the engaged surface of the fabric and a relatively greater force of engagement of the fabric with the sueding roll at the location of second engagement with the sueding roll sufficient to cut constituent yarns of the fabric.

16. Sueding means in a textile warp knitting machine according to claim 13 and characterized further in that the driving means includes means for selectively changing the rotational speed of the sueding roll for adjustment thereof over the life of the abrasive peripheral surface to accommodate for wearing thereof.

17. Sueding means in a textile warp knitting machine according to claim 13 and characterized further in that the driving means in synchronized with the knitting machine for operation in unison to prevent formation of stop marks in the fabric.

18. Sueding means in a textile warp knitting machine according to claim 13 and characterized further in that the sueding roll comprises a hollow cylindrical outer shell and support means with the interior of the shell to prevent distortion of the cylindrical configuration of the shell.

19. Sueding means in a textile warp knitting machine according to claim 18 and characterized further in that the support means comprises an elongate shaft extending axially centrally through the interior oof the shell and a plurality of support plates extending radially between the shaft and the shell at spacings along the shaft.

20. Sueding means in a textile warp knitting machine according to claim 13 and characterized further in that the driving means includes clutch means selectively operable for idling rotation of the sueding roll for non-sueding operation of the knitting machine.

21. In a textile fabric-producing machine of the type having means for manipulating yarn to form a fabric in flat open-width form and a location following the yarn manipulating means for take-up of the fabric, the improvement comprising means for sueding the fabric in full width form intermediate the yarn manipulating means and the take-up location, the sueding means comprising a sueding roll having an abrasive peripheral surface, means for directing the fabric to travel intermediate the yarn manipulating means and the take-up location in peripheral surface engagement with the sueding roll, and means for driving rotation of the sueding roll at a peripheral surface speed compatibly related to the traveling speed of the fabric, the fabric directing means being arranged for engaging the fabric with the peripheral surface of the sueding roll at two distinct locations thereon, and the fabric directing means being operative for tensioning the fabric at the locations of its peripheral surface engagement with the sueding roll to maintain engagement therebetween and for developing a relatively lesser force of engagement of the fabric with the sueding roll at the location of first engagement with the sueding roll sufficient generally only to raise the engaged surface of the fabric and a relatively greater force of engagement of the fabric with the sueding roll at the location of second engagement with the sueding roll sufficient to cut constituent yarns of the fabric.

22. In a textile fabric-producing machine of the type having means for manipulating yarn to form a fabric in flat open-width form and a location following the yarn manipulating means for take-up of the fabric, the improvement comprising means for sueding the fabric in full width form intermediate the yarn manipulating means and the take-up location, the sueding means comprising a sueding roll having an abrasive peripheral surface, means for directing the fabric to travel intermediate the yarn manipulating means and the take-up location in peripheral surface engagement with the sueding roll, and means for driving rotation of the sueding roll at a peripheral surface speed compatibly related to the traveling speed of the fabric, the driving means including clutch means selectively operable for idling rotation of the sueding roll for non-sueding operation of the fabric-producing machine.

23. In a textile warp knitting machine of the type having at least one needle bar for manipulating yarn to knit a fabric in flat open-width form and a driven take-up roll for winding of the fabric, the improvement comprising means for sueding the fabric in full width form intermediate the needle bar and the take-up roll, the sueding means comprising a sueding roll having an abrasive peripheral surface formed of sandpaper, a plurality of guide rolls for directing the fabric to travel intermediate the needle bar and the take-up roll in peripheral surface engagement with the sueding roll at two distinct locations thereon, and means for driving rotation of the sueding roll at a peripheral surface speed compatibly related to the traveling speed of the fabric and in a direction at the peripheral surface of the sueding roll opposite the direction of travel of the fabric, the driving means including clutch means selectively operable for idling rotation of the sueding roll for non-sueding operation of the knitting machine.

* * * * *